United States Patent [19]

Varunes

[11] Patent Number: 4,583,279

[45] Date of Patent: Apr. 22, 1986

[54] METHOD OF MOUNTING AUTOMOTIVE SEAT COVERS

[76] Inventor: Peter G. Varunes, 203 Howard Ave., New Haven, Conn. 06519

[21] Appl. No.: 609,656

[22] Filed: May 14, 1984

[51] Int. Cl.[4] ..... B23P 19/00; B23P 11/00; B68G 7/00

[52] U.S. Cl. ..... 29/526 A; 29/91; 29/243.56

[58] Field of Search ..... 29/91, 526, 765, 243.56; 5/409; 297/452

[56] References Cited

U.S. PATENT DOCUMENTS

| | | | |
|---|---|---|---|
| 3,022,522 | 2/1962 | Neely | 5/409 |
| 3,727,980 | 4/1973 | Tischler | 297/452 |
| 4,191,424 | 3/1980 | Mundell | 297/452 |
| 4,379,352 | 4/1983 | Hauslein et al. | 297/452 |

*Primary Examiner*—Howard N. Goldberg
*Assistant Examiner*—Steven Nichols
*Attorney, Agent, or Firm*—Walter Spruegel

[57] ABSTRACT

Anchor track for attachment thereto of a seat cover through intermediation of C-rings, with the anchor track having serrations for locking C-rings thereto, and being secured to bottoms of front and side channels of automotive front seat frame.

4 Claims, 9 Drawing Figures

Fig. 9
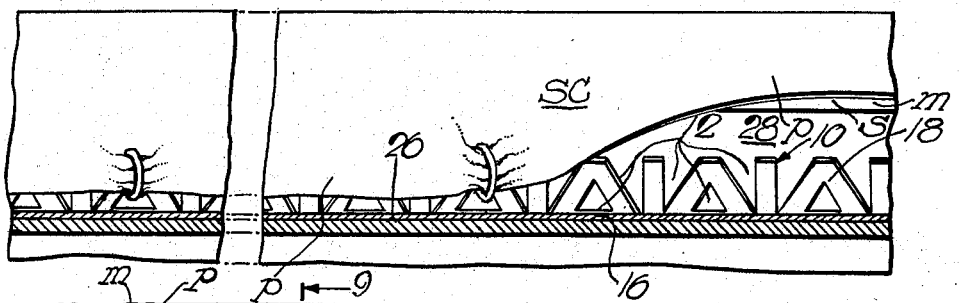
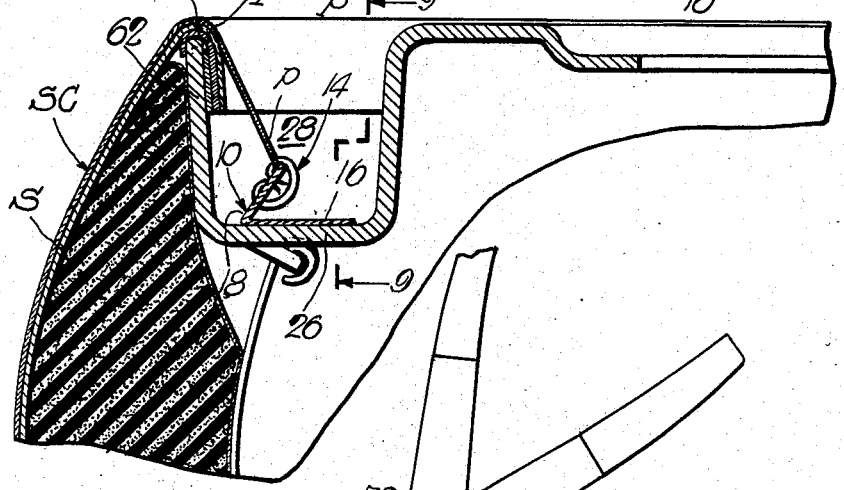
Fig. 8
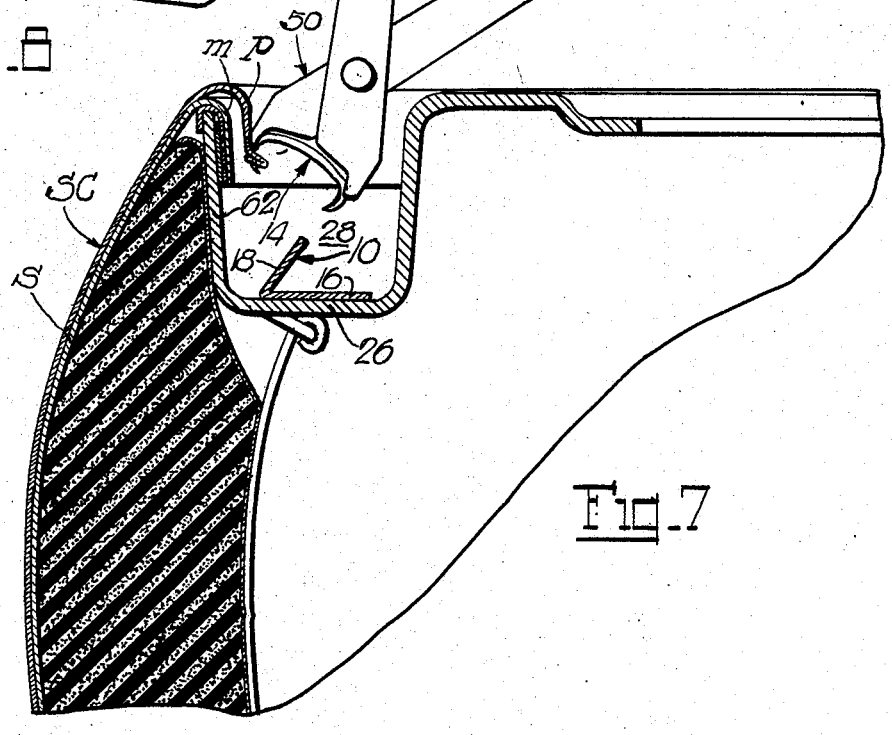
Fig. 7

METHOD OF MOUNTING AUTOMOTIVE SEAT COVERS

This invention relates to seat covers in general, and to a method of mounting automotive seat covers in particular.

In present-day mountings of seat covers on automotive front and rear seats, those seat covers designated for rear seats can be mounted with suitable fasteners rather satisfactorily; i.e., fairly snugly and with an adequate fit, because automotive rear seat frames afford enough suitable formations that may serve as adequate anchor posts for such fasteners. In distinct contrast thereto, present-day front seat covers do not lend themselves to nearly as satisfactory mounting as do rear seat covers. This is due to the fact that automotive front seat frames are custom-engineered steel bodies with finished movable undercarriages on bottom tracks for front seat adjustment, and a rectangular base along the front and sides of the frame in the form of an inverted channel, with the front and side margins of the seat fabric of an upholstered front seat being folded about the bottom of the outer leg of the base channel, and being by suitable tape means locked to the inside of this channel, and the remaining back side of the seat fabric being by a few suitable fasteners secured to readily accessible seat springs in back of the seat. However, while these automotive front seat frames are well-equipped for their seat adjustment and especially for their fabric mounting, they are devoid of any provisions whatever for mounting front seat covers thereon. Thus, with these automotive front seat frames being without any provisions for mounting a seat cover thereon, it has become customary to fold front and side margins of the seat cover over the initially folded front and side margins of the seat fabric on the outer leg of the base channel, whereupon simple clips are slipped over the folded seat cover margins in order to hold the same clamped in place against the channel leg therebeneath. However, the seat cover mountings afforded by such slipped-on clips are not very reliable in use and lack desired holding strength so that they come loose all too easily. Moreover, such slipped-on clips present anything but a sightly appearance.

It is a primary object of the present invention to provide a method of mounting on automotive seats, and especially front seats, seat covers which for such mount rely on well-known depressible C-rings. However, present-day front seat frames being devoid of any provisions for mounting seat covers thereon as aforementioned, and hence lacking any anchor provisions for C-rings, are of no avail unless they are equipped with anchor formations.

Accordingly, it is another primary object of the present invention to provide automotive front seat frames with anchor formations for C-rings. In this connection, the aforementioned seat fabric mounting on a present-day automotive front seat frame affords unique suggestions of advantageous arrangements of the anchors on the front seat frame for the attainment of a lasting and especially well-tailored fit of an applied seat cover on the front seat. Thus, the featured continuously folded front and side margins of the seat fabric about the bottom of the outer leg of the inverted base channel of the front seat frame, coupled with the tape means locking the folded seat margins to the inside of this channel, suggests advantageous arrangement of the anchors in straight front and side rows at the same horizontal level. Also, the stressed continuity of the folded front and side margins of the seat fabric about the bottom of the outer channel leg points still further at an advantageous construction of multitudinous anchors in the form of separate low-cost anchor tracks which on being cut to proper lengths are suitably secured by riveting or spot-welding, for example, to the front seat frame. Such anchor tracks may take the simple form of blanked or otherwise formed metal strips with multiple serrations. Thus, the featured continuously folded front and side margins of the seat fabric about the bottom of the outer leg of the inverted base channel even takes a part in suggesting for the first time the provision on automotive front seat frames of separate parts, i.e., the referred-to anchor tracks, for anchoring the C-rings to the front seat frames.

It is still another primary object of the present invention to provide automotive front seat frames with the aforementioned separate anchor tracks for securement thereto of front seat covers through intermediation of C-rings. These anchor tracks are applied to the front and sides of the inverted base channels of an automotive front seat frame. Preferably and advantageously, these anchor tracks are placed on the bottom of the inverted channels preferably midway thereof, whereupon holes, and preferably blind holes, are drilled into the bottoms of the channels, with the drills being thereby passed through serrations in the anchor tracks before drilling into the bottoms of the channel. Having thus formed the blind holes in the bottoms of the channels, so called pop-rivets are forced into these holes to therein expand and thereby lock the anchor tracks to the channels. Having thus applied the anchor tracks to the inverted channels of the front seat frame, the seat cover to be applied is spread over the seat, and its front and side margins are folded over the previously applied folded margins of the seat fabric on the outer channel leg, whereupon an operator proceeds to apply C-rings successively to the cover margins and serrations in the anchor tracks and thereby locks the cover margins to the anchor tracks on depressing the C-rings in well-known manner.

Further objects and advantages of the present invention will be apparent from the specification and claims and from the accompanying drawings, in which:

FIG. 7 is an enlarged fragmentary section through an automotive front seat to which a seat cover is being applied;

FIG. 8 is a section similar to FIG. 7 showing a more advanced stage in the mounting of the seat cover; and FIG. 9 is a fragmentary section taken substantially on line 9—9 of FIG. 8.

Figures 1, 2, 3, 4, 5, 6:
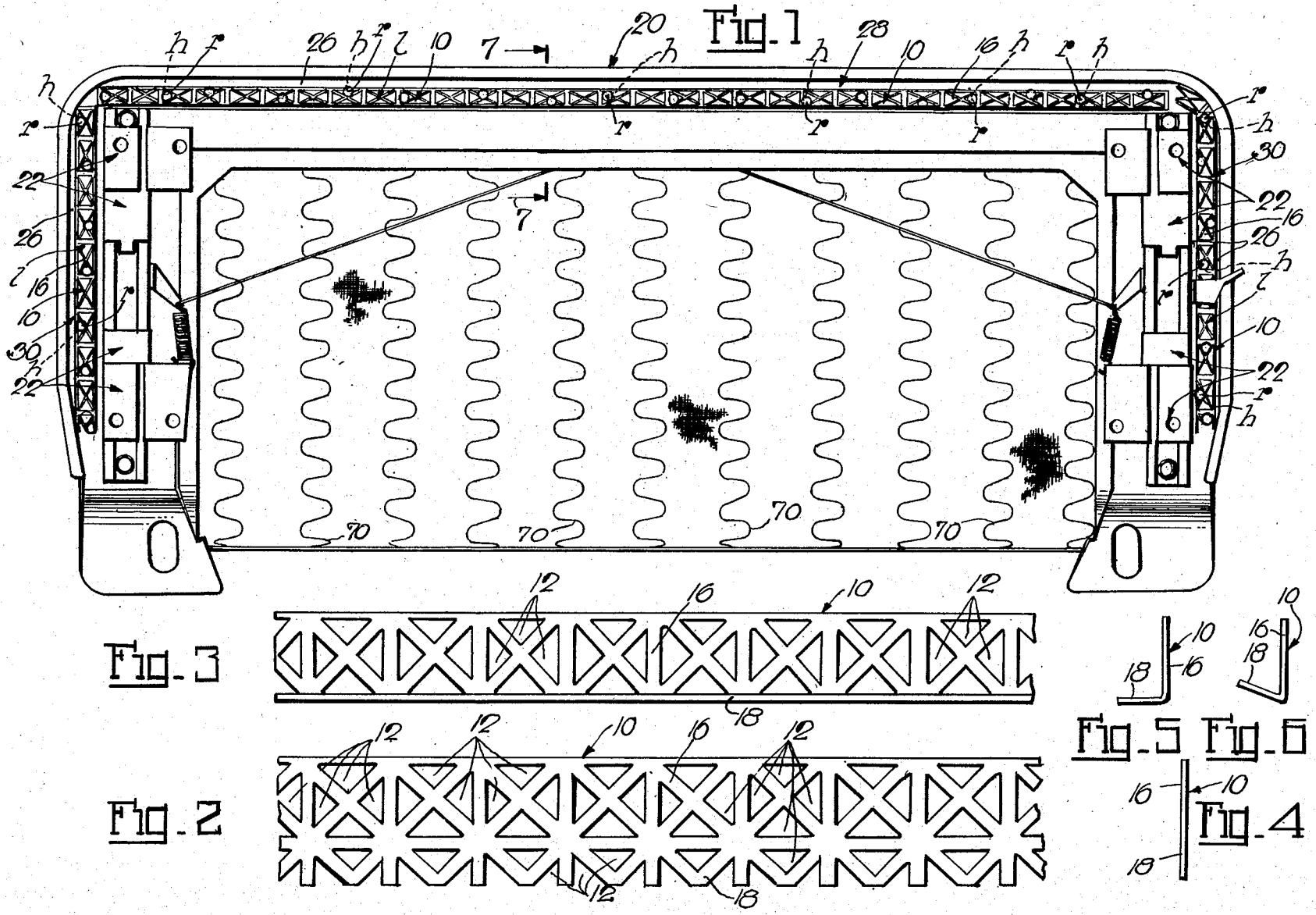
FIG. 1 is a plan view of a removed and inverted automotive front seat preparatory to mounting a seat cover theron.
FIG. 2 is a fragmentary view of a featured anchor track blank.
FIG. 3 is a side view of the anchor track blank of FIG. 2.
FIG. 4 is a view of a finished anchor track after forming the blank of FIG. 2 with a depending flange.
FIG. 5 is a side view of a finished anchor track.
FIG. 6 is a side view of an anchor track with its flange bent sideways.

Referring to the drawings, and more particularly to FIGS. 2 to 6 thereof, the reference numeral 10 designates an anchor track in the form of a metal strip featuring holes, in this instance multitudinous serrations 12 for anchorage thereto of C-rings 14 (FIGS. 7 to 9). The anchor track 10 is conveniently blanked from metal strip stock to provide in this instance the multitudinous serrations 12, and the track 10 is formed with a base leg 16 and a ring-applying leg 18 which is bent as a flange-like projection from the base leg 16. The anchor track 10 may be of any convenient stock length and may be cut to size for use in automotive front seats.

FIG. 1 shows an automotive front seat 20 preferably removed from the automobile and in convenient inverted position for mounting a seat cover thereon in accordance with a method which, like the seat cover mounting itself, features the present invention. The front seat 20 is free to be removed from the automobile by merely removing a few bolts from undercarriages 22 on the seat. An operator next places lengths l of anchor track 10 with their base legs 16 midway onto bottoms 26 of the front and side channels 28 and 30 of the front seat base (FIG. 1). The anchor track lengths l thus placed onto the bottoms 26 of the front and side channels 28 and 30 are next secured in place on these channel bottoms 26, and an operator will to this end force a power drill into these channel bottoms to drill as many blind holes h thereinto as will be required securely to hold these anchor track lengths in place on subsequently forcing pop-rivets r in the blind holes. In thus drilling the blind holes in the bottoms of the channels 28 and 30, the operator will avoid drilling into the anchor tracks and lead the drill through serrations to the channel bottoms for drilling the required blind holes therein, with the pop-rivets having heads overlying the anchor track lengths for their retention on the channel bottoms.

With the anchor track lengths being thus applied to the channel bottoms (FIG. 1), the operator will spread the seat cover SC over the seat and proceed progressively to secure marginal portions of the cover to the installed anchor track through intermediation of C-rings 14 and with the aid of special pliers 50 (FIG. 7). To this end, the operator will first fold marginal portions P of the seat cover progressively over the previously applied folded margins m of the seat fabric S on the outer channel leg 62 (FIG. 7), whereupon the operator proceeds to apply C-rings 14 successively to the cover margins P and serrations in the anchor tracks and thereby locks the seat cover margins to the anchor tracks and hence, also to the front seat on depressing the C-rings 14 with the pliers 50 in well-known manner (FIGS. 7 to 9). The operator then repeats the progressive folding of new marginal portions of the seat cover over the previously folded margins m of the seat fabric on the outer channel leg, and then again proceeds to apply C-rings successively to the newly folded cover margins P and next serrations in the anchor tracks. The operator thus repeats this procedure until he worked the seat cover margins P all around the side and front channels and thereby locked them thereto, whereupon it will be merely necessary to conclude the operation by applying a few fasteners to the rear of the seat cover and to a few nearby seat springs 70.

What is claimed is:

1. The method of mounting a seat cover on an automotive front seat having inverted front and side channels, and a seat fabric folded with its front and side margins over the outer legs of said front and side channels to the inside of said legs and being secured thereto, said method comprising extending a metal strip in said channels along the bottoms thereof and securing it thereto, with said strip having over its length anchor holes for C-rings, folding the front and side margins of a seat cover over the folded front and side margins of the seat fabric on the outer legs of said channels and extending them toward the adjacent metal strip, and applying C-rings to said extended margins of the seat cover and adjacent holes in said metal strip.

2. The method of claim 1, in which said metal strip is of L-section having a base leg and a ring-applying leg, of which said base leg lies on the bottoms of said channels and is secured thereto, and said ring-applying leg forms an acute angle with said base leg and leans away from said outer channel legs, with at least said ring-applying leg being provided with said holes.

3. The method of claim 2, in which said metal strip is serrated throughout.

4. The method of claim 3, in which said metal strip is secured to said channel bottom by passing a power drill with clearance through a serration in said base leg of said metal strip and then drilling a blind hole into the channel bottom, and then forcing a pop-rivet into said blind hole.

* * * * *